US005745824A

United States Patent [19]

Yashiro

[11] Patent Number: 5,745,824

[45] Date of Patent: Apr. 28, 1998

[54] CONNECTING PART FEATURE FOR A PROCESS CARTRIDGE

[75] Inventor: Masahiko Yashiro, Yokohama, Japan

[73] Assignee: Canon Kabushiki Kaisha, Tokyo, Japan

[21] Appl. No.: 800,760

[22] Filed: Feb. 13, 1997

Related U.S. Application Data

[63] Continuation of Ser. No. 545,168, Oct. 19, 1995, abandoned, which is a continuation of Ser. No. 432,588, May 1, 1995, abandoned, which is a division of Ser. No. 949,866, Nov. 23, 1992, Pat. No. 5,450,166.

[30] Foreign Application Priority Data

Apr. 10, 1991 [JP] Japan ..... 3-77606
Apr. 10, 1992 [JP] Japan ..... 4-00450

[51] Int. Cl.[6] ..... G03G 21/18

[52] U.S. Cl. ..... 399/113

[58] Field of Search ..... 29/469; 403/111, 403/386, 388; 399/111, 113, 119

[56] References Cited

U.S. PATENT DOCUMENTS

| | | | |
|---|---|---|---|
| 4,866,482 | 9/1989 | Hirasawa et al. | 355/260 |
| 5,028,966 | 7/1991 | Kozuka et al. | 355/210 X |
| 5,061,959 | 10/1991 | Kinoshita et al. | 355/210 |
| 5,115,272 | 5/1992 | Ohmori et al. | 355/200 |
| 5,153,649 | 10/1992 | Park | 355/260 |
| 5,450,166 | 9/1995 | Yashiro | 355/210 |

FOREIGN PATENT DOCUMENTS

| | | |
|---|---|---|
| 0329145 | 8/1989 | European Pat. Off. . |
| 0405514 | 1/1991 | European Pat. Off. . |
| 3907875 | 9/1989 | Germany . |
| 60-168175 | 8/1985 | Japan . |
| 61-279870 | 12/1986 | Japan . |
| 1-244472 | 9/1989 | Japan . |
| 3-15864 | 1/1991 | Japan . |

*Primary Examiner*—Joan H. Pendegrass
*Attorney, Agent, or Firm*—Fitzpatrick, Cella, Harper & Scinto

[57] ABSTRACT

The present invention realizes to shorten the assembling process of a process cartridge, by employing a first support member supporting an image bearing member, a second support member supporting a development unit for acting on the image bearing member to thereby develope an image of the image bearing member, a defining member for defining the rotary shaft between the first and second support members, and a compression spring for generating an elastic force between the image bearing member and the development unit.

37 Claims, 8 Drawing Sheets

100
100a
107
107a
107b
107d
107e
107e1
107e2
107e3
104
305
123
123a
123b
123c
124
106
106a
106b
106d
106e
200
200a
200b
250
B
C

CONNECTING PART FEATURE FOR A PROCESS CARTRIDGE

This application is a continuation of application Ser. No. 08/545,168, filed Oct. 19, 1995, now abandoned, which is a continuation of application Ser. No. 08/432,588, filed May 1, 1995, now abandoned, which is a division of application Ser. No. 07/949,866, filed Nov. 23, 1992, which issued as U.S. Pat. No. 5,450,166 on Sep. 12, 1995.

FIELD OF THE INVENTION

The present invention relates to a process cartridge, a recording apparatus and a method for assembling a process cartridge.

The process cartridge means an integral unit including at least an image bearing member (for example an electrophotographic photosensitive member) and developing means, rendered attachable to and detachable from a recording apparatus.

The recording apparatus can be, for example, an electrophotographic copying apparatus, a laser beam printer (LBP), a facsimile apparatus, a word processor or the like.

DESCRIPTION OF THE RELATED ART

In the following there will be explained the background art of the present invention.

FIGS. 1(*a*) and 1(*b*) are views showing the background art of the present invention, wherein FIG. 1(*a*) is a schematic lateral cross-sectional view of a process cartridge not mounted on the recording apparatus, and FIG. 1(*b*) is a perspective view in which the process cartridge is divided into a developing unit and a cleaner unit.

As shown in FIGS. 1(*a*) and 1(*b*), a photosensitive drum unit 7 is provided with a photosensitive drum 4, and a cleaning blade 7*a* and a used toner reservoir 7*b* constituting a cleaner 7*e* for cleaning the periphery of said photosensitive drum 4.

Also a developing unit 6 is provided with a developing sleeve 6*a* and a toner reservoir 6*b* constituting a developer 6*i*. (In these drawings, the toner in the toner reservoir 6*b* and in the used toner reservoir 7*b* is omitted.)

Pins 6*d* formed on arms 6*c* of the unit 6 are fitted in holes 7*c* of the unit 7, and are then prevented from displacement in the thrust direction by a thrust stopper 6*f* such as a ring, fitted on a groove 6*e* of the pin 6*d*. Thus the units 6, 7 are mutually rotatable about said pins 6*d*. Subsequently tension springs 9 are applied between pins 6*g* provided on both sides of the unit 6 and pins 7*d* provided on both sides of the unit 7, thereby generating a tensile force between the units 6 and 7. Thus the units 6, 7 are integrated in a state in which the photosensitive drum 4 and the developing sleeve 6*a* are mutually contacted with a predetermined pressure in a direction A.

When the process cartridge 1 is mounted on a laser beam printer (not shown), the photosensitive drum 4 is driven by a driving gear (not shown) of the main body of the apparatus, while the developing sleeve 6*a* is rotated by a developing roller gear 6*h* meshing with a photosensitive drum gear 4*a*. In general, the pins 6*d* and the holes 7*c* are positioned in the angular direction of meshing pressure of said gears, in order not to receive the force in the rotational direction.

However, the above-explained process cartridge requires a cumbersome operation in the assembling, as the tension springs 9 cannot be placed between the pins 6*g* and 7*d* unless they are once extended with a force exceeding the necessary tensile force. Also in case of disassembling the process cartridge into the cleaner 7 and the developer unit 6 for maintenance or the like, there have to be detached the springs 9 and then the thrust stopper 6*f*. In this manner cumbersome operations are involved in the assembling and disassembling of such conventional process cartridge.

On the other hand, the present applicant made an invention enabling the process cartridge to be made compact by the use of compression coil springs in contacting the developing sleeve with the photosensitive drum with a predetermined pressure, and applied for a patent in Japan on this invention (Japanese Patent Application No. 63-69735, filed Mar. 25, 1988; Japanese Patent Laid-open Application No. 1-244472, laid open Sept. 28, 1989).

The present invention is an extension of the above-mentioned background art and of the above-explained invention of the present applicant.

SUMMARY OF THE INVENTION

An object of the present invention is to provide a process cartridge enabling further compactization, an image forming apparatus adapted therefor, and a method for assembling such process cartridge.

Another object of the present invention is to provide a process cartridge capable of reducing the assembling process, an image forming apparatus adapted therefor, and a method for assembling such process cartridge.

Still another object of the present invention is to provide a process cartridge capable of reducing the disassembling process, an image forming apparatus adapted therefor, and a method for assembling such process cartridge.

Still another object of the present invention is to provide a process cartridge with improved assembling and disassembling property, an image forming apparatus adapted therefor, and a method of assembling such process cartridge.

In one aspect of the invention, there is provided a connecting part for assembling a process cartridge having first and second frames. The connecting part has a base member, a protrusion provided on the base member, a spring disposed on the base member adjacent to the protrusion, and a hole allowing penetration of a screw used for fastening the base member to one of the first and second frames, wherein the protrusion locks a rotation shaft provided on the second frame to the first frame rockably, the spring presses the second frame in a direction to urge a developing roller in the second frame toward a photosensitive member in the first frame, and the base member is fastened to the first frame Another aspect of the present invention provides a connecting part, for assembling a process cartridge having first and second frames, which includes a base member, a protrusion provided on the base member, a spring disposed on the base member adjacent to the protrusion, and a hole allowing penetration of a screw used for fastening the base member to one of the first and second frames, wherein the connecting part assembles the process cartridge by rockably locking the first frame, which supports an image bearing member, to the second frame, which supports developing means for developing a latent image formed on the image bearing member.

Yet another aspect of the present invention provides a connecting part, for assembling a process cartridge having first and second frames, which includes a base member, a protrusion provided on the base member, a spring disposed on the base member adjacent to the protrusion, and a hole allowing penetration of a screw used for fastening the base member to one of the first and second frees, wherein the spring comprises a compression spring and the base member comprises an attaching seat for attaching the compression spring to the base member.

Still another aspect of the present invention provides a connecting part, for assembling a process cartridge having first and second frames, which includes a base member, a protrusion provided on the base member, and a spring disposed on the base member adjacent to the protrusion, wherein the protrusion locks a rotation shaft provided on the second frame to the first frame rockably, the spring presses the second frame in a direction to urge a developing roller in the second frame toward a photosensitive member in the first frame, and the base member is fastened to the first frame.

A further aspect of the present invention provides a connecting part, for assembling a process cartridge having first and second frames, which includes a base member, a protrusion provided on the base member, and a spring disposed on the base member adjacent to the protrusion, wherein the connecting part assembles the process cartridge by rockably locking the first frame, which supports an image bearing member, to the second frame, which supports developing means for developing a latent image formed on the image bearing.

Still a further aspect of the present invention provides a connecting part, for assembling a process cartridge having first and second frames, which includes a base member, a protrusion provided on the base member, and a spring disposed on the base member adjacent to the protrusion, wherein the spring comprises a compression spring and the base member comprises an attaching seat for attaching the compression spring to the base member.

Yet another aspect of the present invention provides a connecting part used for assembling a process cartridge having a first frame and a second frame, wherein the first frame supports an electrophotographic photosensitive drum and has at both ends thereof above the photosensitive drum a first opening into which a protrusion of the connecting part can be inserted, a second opening into which a spring of the connecting part can be inserted, a screwing portion for screwing a base member of the connecting part by a screw member, between the first opening and the second opening, and an engaging portion having one side open to permit passage of a shaft of the second frame, while the second frame supports developing means and has at both ends thereof above the developing means concave portions for receiving the spring of the connecting part. The connecting part is characterized in that it includes a base member, a protrusion provided on the base member, a spring provided on the base member adjacent to the protrusion, and a screw hole allowing penetration of the screw member for fastening the base member to the first frame.

Still a further aspect of the present invention provides a connecting part used for assembling a process cartridge having a first frame and a second frame, wherein the first frame supports an electrophotographic photosensitive drum and has at both ends thereof above the photosensitive drum a first opening into which a protrusion of the connecting part can be inserted, a second opening into which a spring of the connecting part can be inserted, and an engaging portion having one side open to permit passage of a shaft of the second frame, while the second frame supports developing means and has at both ends thereof above the developing means concave portions for receiving the spring of the connecting part. The connecting part is characterized in that it includes a base member, a protrusion provided on the base member, and a spring provided on the base member adjacent to the protrusion.

Owing to the above-mentioned characteristic configurations of a connecting part, the present invention allows simplification of the assembling process of a process cartridge, since, because of the characteristic configurations, the present invention allows assembly of a process cartridge without the use of a tension spring. Also, because of the characteristic configurations, the present invention allows mounting of a compression spring in an easy manner during the assembly of the process cartridge.

DESCRIPTION OF THE PREFERRED EMBODIMENTS

Now the present invention will be clarified in detail by preferred embodiments thereof shown in the accompanying drawings.

Figure 1B:
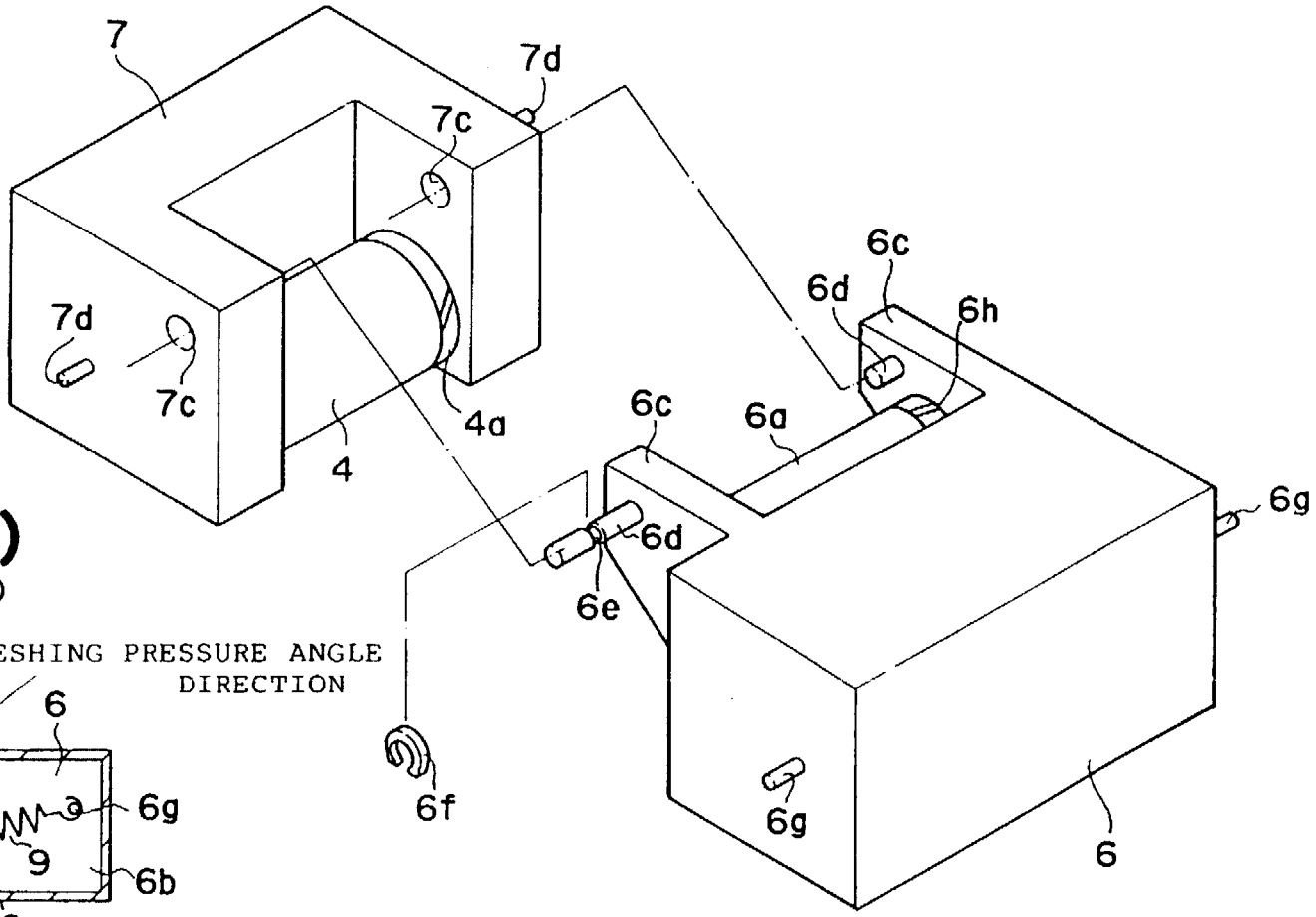
FIG. 1(b) (PRIOR ART)
FIGS. 1(*a*) and 1(*b*) are respectively a lateral cross-sectional view and a perspective view, showing the background art of the present invention.
Figure 1A:
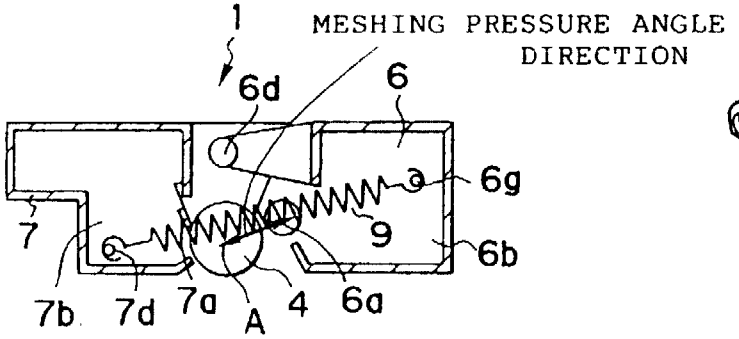
FIG. 1(a) (PRIOR ART)
Figures 2A, 2B, 2C:
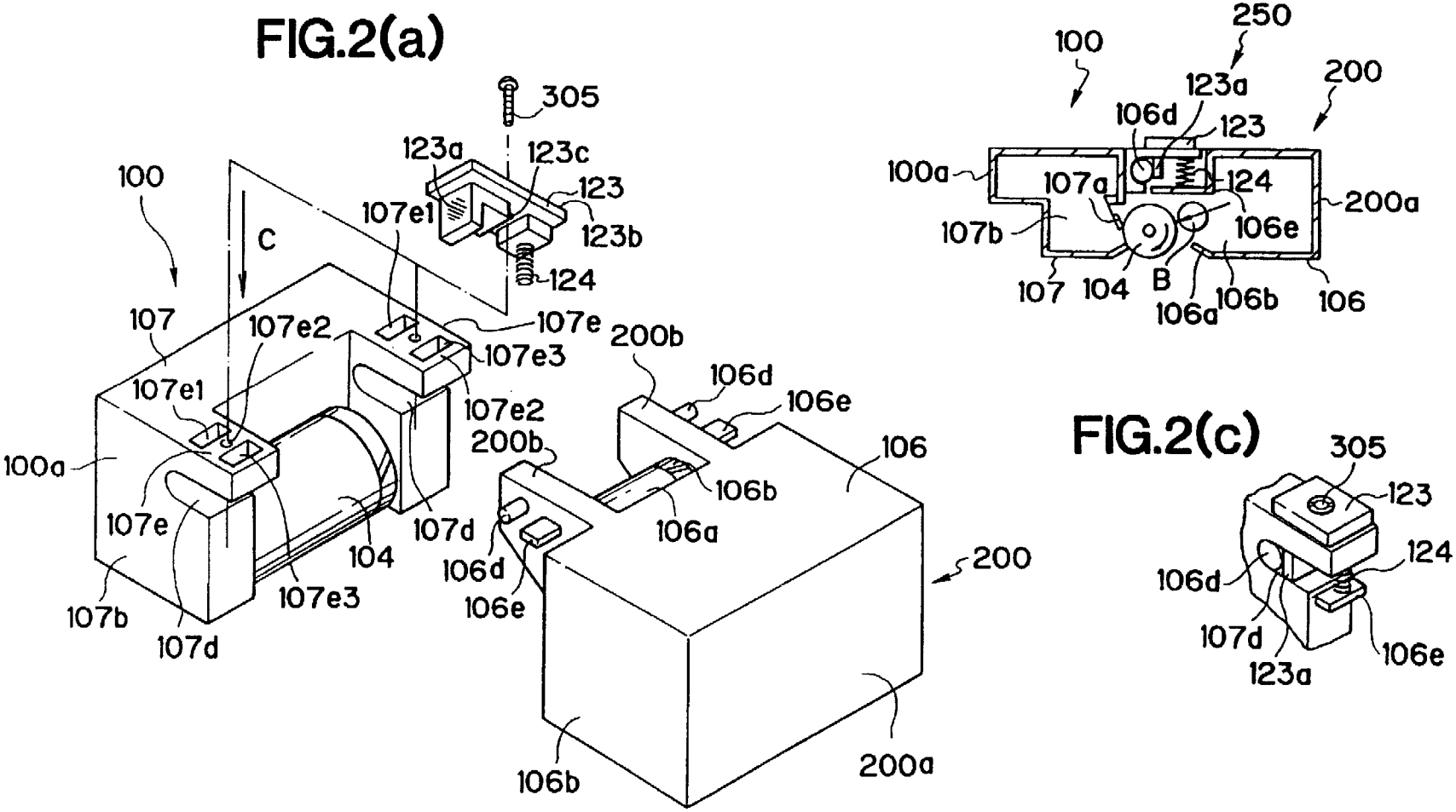
FIGS. 2(*a*), 2(*b*) and 2(*c*) are respectively a perspective view, a lateral cross-sectional view and a perspective view showing a combined state, of a preferred embodiment of the process cartridge of the present invention.

FIGS. 2(*a*) and 2(*b*) are respectively a schematic perspective view and a schematic cross-sectional view of a preferred embodiment of the process cartridge of the present invention. FIG. 2(*a*) illustrates a state in which a photosensitive drum unit 100 and a developing unit 200 are mutually disassembled.

In the present embodiment, a process cartridge 300 is constructed by coupling the photosensitive drum unit 100 and the developing unit 200. The photosensitive drum unit 100 rotatably supports an electrophotographic photosensitive drum 104 in a frame 100*a*, by means of bearings. It also is provided with a cleaning blade 107*a* and a used toner reservoir 107*b*, constituting a cleaner 107 for cleaning the periphery of the photosensitive drum 104. On the other hand, the developing unit 200 supports, in a frame 200*a*, a developing sleeve 106*a* and a toner reservoir 106*b*, constituting a developing device 106, wherein the developing sleeve 106*a* serves to transport the toner in the toner reservoir 106*b* to a developed area of the photosensitive drum 104.

In the following there will be explained a procedure for coupling the photosensitive drum unit 100 and the developing unit 200.

In the present embodiment, cylindrical projections 106*d*, formed on arms 200*b* of the developing unit 200 are fitted in U-shaped grooves 107*d* provided in the drum unit 100, and, after the fitting of the units 100, 200 in this manner, a stopper unit 123 in which a pressurizing spring (compression spring in this case) 124 is integrated (for example by snap fitting of an end of the compression spring) is fitted in a fixing part 107*e*, positioned above each of the U-shaped grooves 107*d*. Then the stopper unit 123 is fixed to the unit 100 by a screw 305 inserted in a direction c. In this operation, a face 123*a* of the stopper unit 123 and the U-shaped groove 107*d* define the position of the projection 106*d* of the developing unit 200, thereby limiting the position thereof. Also the pressure springs 124 press spring seats 106*e* of the developing unit 200, thereby applying a biasing force in a direction B of mutual impingement of the photosensitive drum 104 and the developing sleeve 106*a*.

The stopper unit 123 is integrally provided with a base plate 123*b*, a fixing screw hole 123*c* provided therein, a perpendicular plate 123*a* formed on said base plate 123*b*, and a compression spring 124.

On the other hand, the fixing part 107*e* formed in the drum unit 100 is provided with a hole 107*e*1 into which said perpendicular plate 123*a* is to be fitted, a female thread part 107*e*2 for fixing the screw 305, and a hole 107*e*3 for passing the spring 124.

Thus, after the projections (pins) 106*d* of the unit 200 are fitted in the deepest parts of the grooves 107*d* of the unit 100, the stopper units 123 are fixed on the fixed parts 107*e*. More specifically, the perpendicular plate 123*a* of the stopper unit 123 is fitted in the hole 107*e*1, while the spring 124 is made to pass through the hole 107*e* and to be received in a compressed state by the spring seat 106*e* of the unit 200, and the screw 305 is fixed, through the screw hole 123*c*, into the female thread part 107*e*2.

In this manner the units 100 and 200 are coupled so as to be mutually rotatable about the pins 106*d*, thereby completing the process cartridge 250. The positional relationship between the periphery of the photosensitive drum 104 and that of the developing sleeve 106*a* is defined in thus coupled state of the units 100, 200, and the developing sleeve 106*a* is pressed toward the photosensitive drum 104 by the elastic force of the compression springs 124. (In the present embodiment, the elastic force of the compression springs is selected at about 2 kg, whereby a pressing force of about 1 kg is applied to the developing sleeve.)

A drum gear 104*a*, provided at a side of the photosensitive drum 104, meshes with a developing sleeve gear 106*b*, provided at a side of the developing sleeve 106*a*, thereby transmitting the rotating force, received from the main body of the printer, to the developing sleeve.

In the above-explained configuration, the developing unit 106 can be attached or detached in the direction of the U-shaped grooves 107*d*. Consequently the projections (pins) 106*d* can both be constructed outwards (or inwards), so that the thrust stopper can be dispensed with.

Also as the stopper unit 123 is inserted in the direction C and fixed in said direction, the pressurizing of the developing device can be realized simultaneously with the mounting of the stopper unit 123, and there is no longer required the conventional cumbersome operation of mounting the tension springs.

Also at the disassembling, the pressure is gradually released by loosening the stopper units, and the disassembling operation is extremely easy because of the absence of the thrust stopper.

Thus, the above-explained embodiment realizes the positioning of the developing device relative to the image bearing member, by means of a unit provided with compression springs, thereby improving the assembling and disassembling property of the process cartridge.

In the present embodiment, the photosensitive drum unit supports the cleaner, but such configuration is not essential. The process Cartridge of the present invention needs only to be attachable to and detachable from the main apparatus in a state in which at least the photosensitive drum and the developing unit are integrally supported.

In the following, there will be explained another preferred embodiment of the present invention, with reference to FIGS. 3 to 7.

Figure 3:
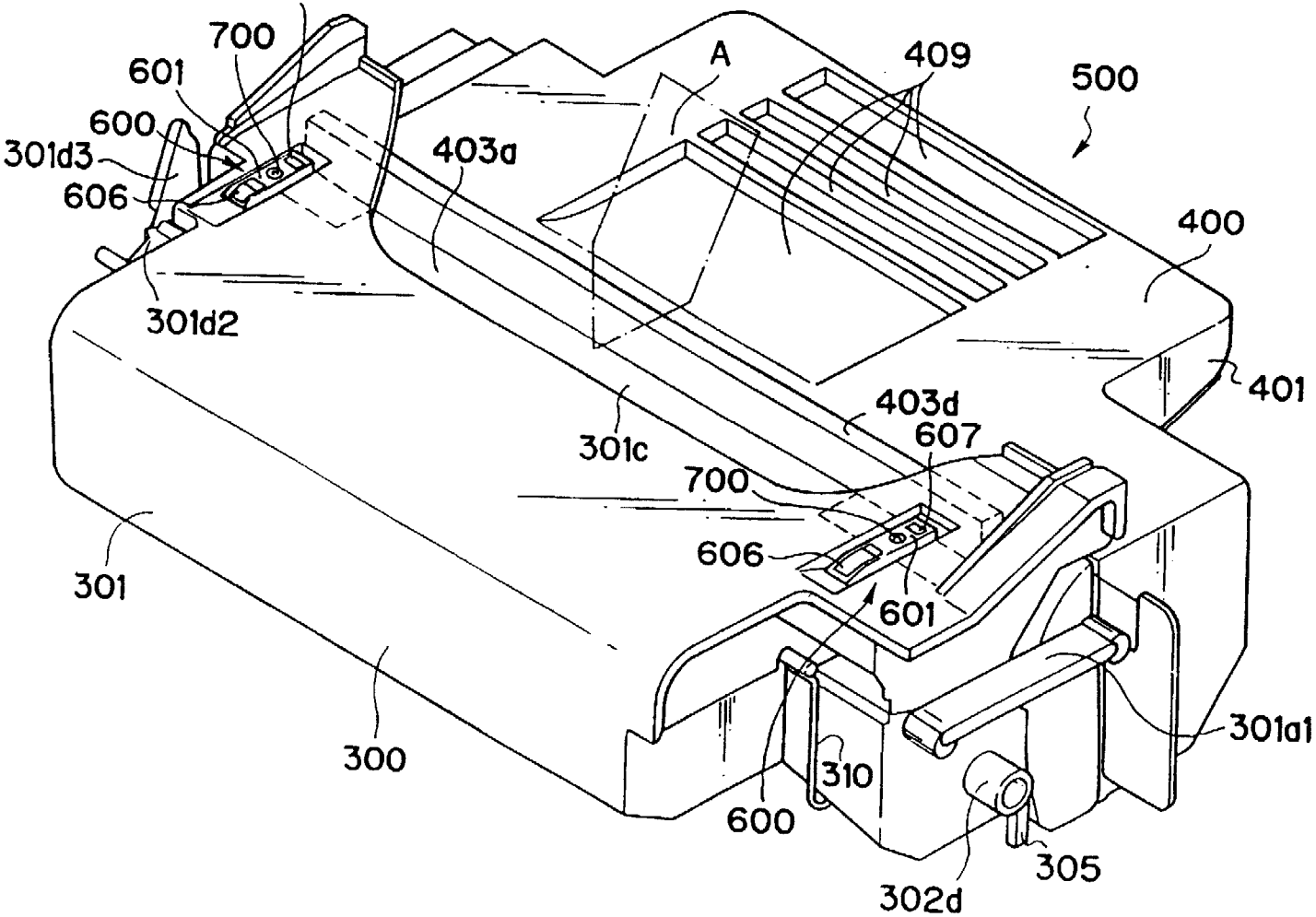
FIG. 3 is an external perspective view of a preferred embodiment of the process cartridge of the present invention.
Figure 4:
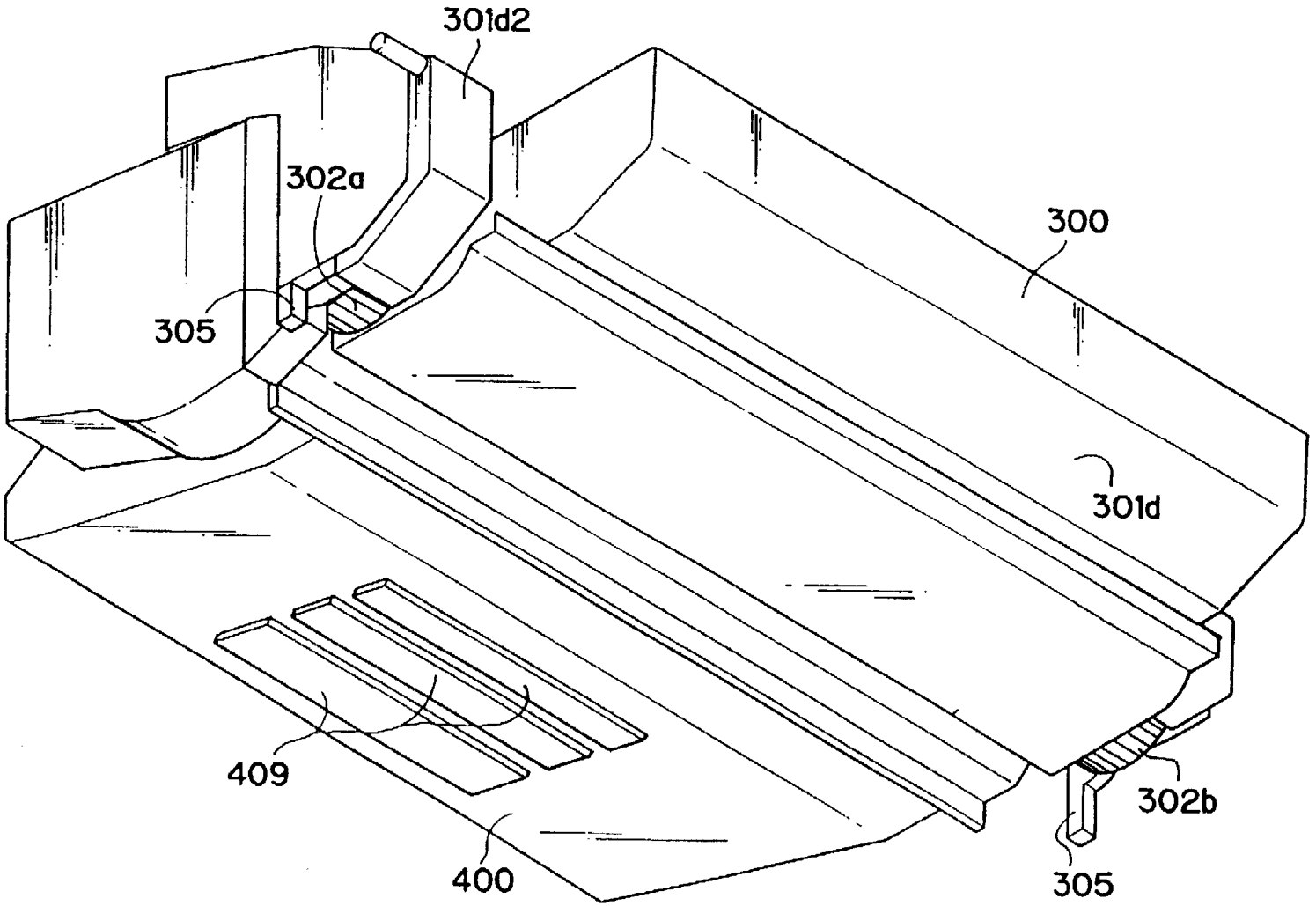
FIG. 4 is an external perspective view, seen from below, of the process cartridge shown in FIG. 3.
Figure 5:
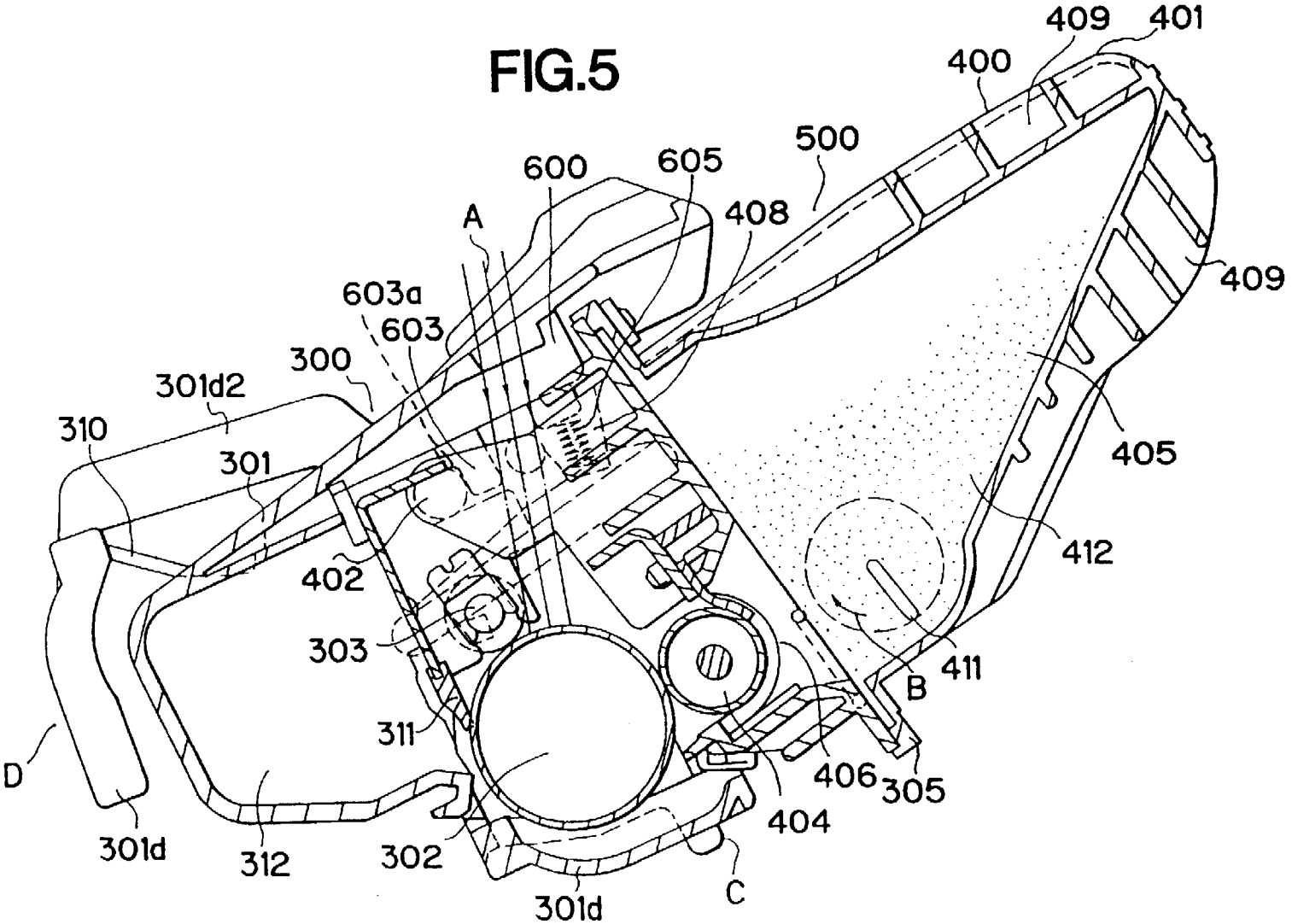
FIG. 5 is a lateral cross-sectional view of the process cartridge shown in FIG. 3.
Figure 6A:
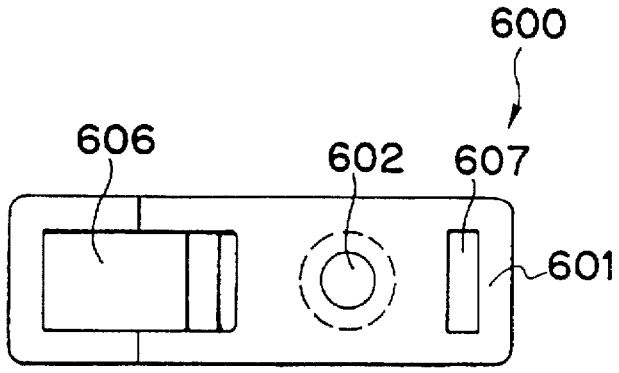
FIGS. 6(*a*) and 6(*b*) are respectively a plan view and a lateral view of an embodiment of coupling means adapted in the present invention.
Figure 6B:
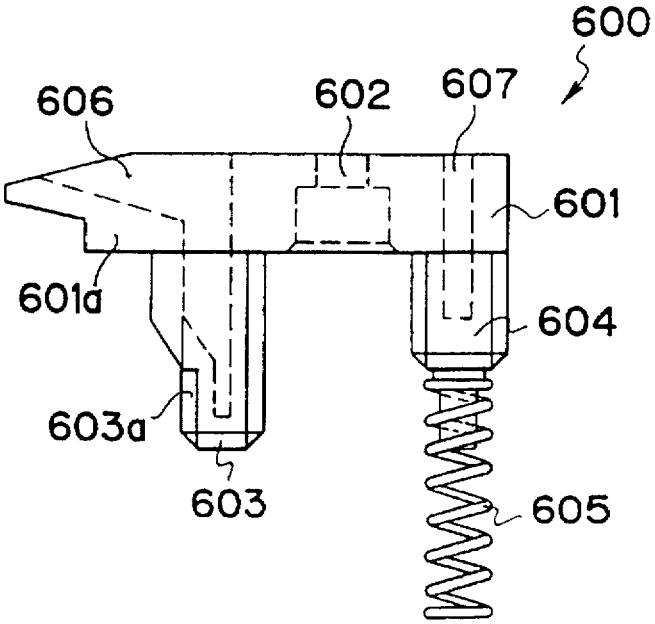
Figure 7A:
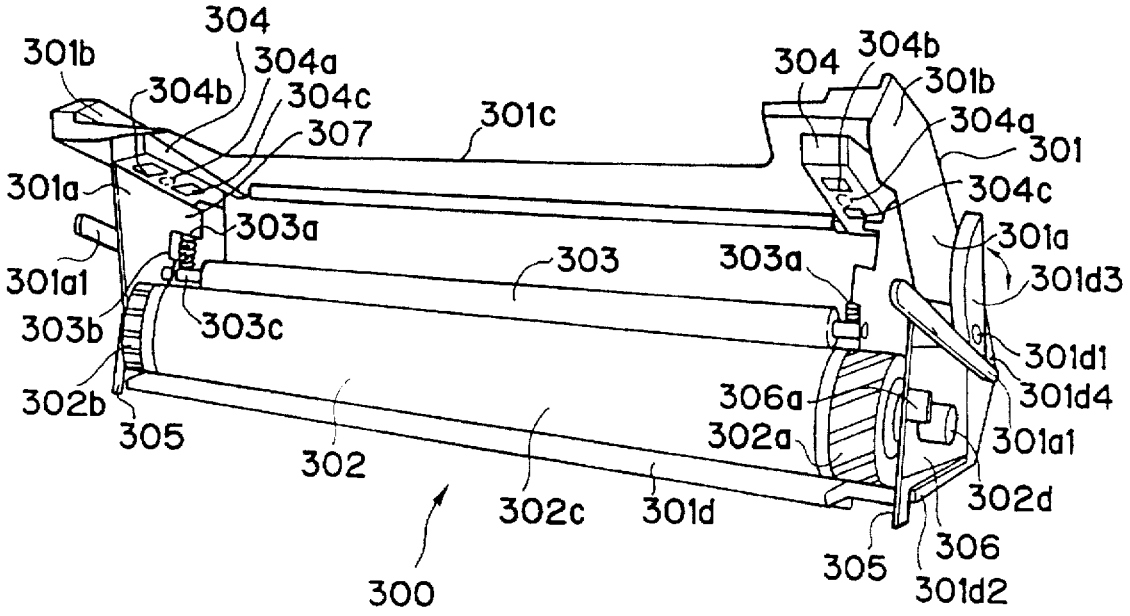
FIGS. 7(*a*) and 7(*b*) are perspective views respectively of a photosensitive drum unit and a developing unit, constituting the process cartridge shown in FIG. 3.
Figure 7B:
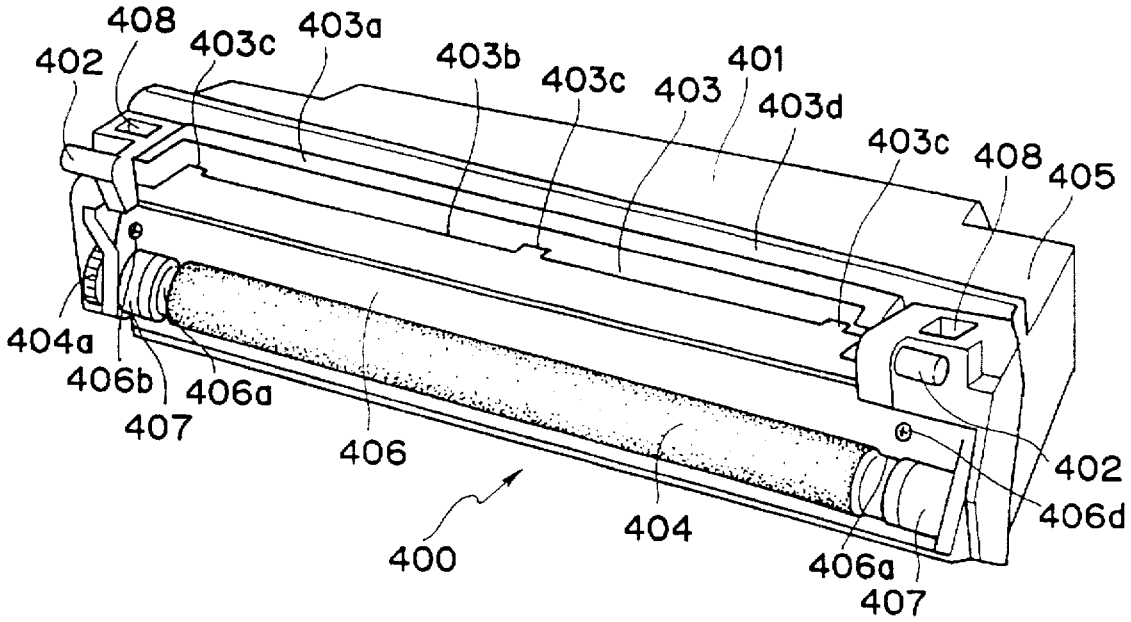

FIG. 3 is an external perspective view, seen from above, of a preferred embodiment of the process cartridge of the present invention, FIG. 4 is an external perspective view thereof seen from below, FIG. 5 is a lateral cross-sectional view of the process cartridge shown in FIG. 3, FIGS. 6(*a*) and 6(*b*) are respectively a plan view and a lateral view of an embodiment of the coupling means, and FIGS. 7(*a*) and 7(*b*) are perspective views respectively of a photosensitive drum unit and a developing unit, constituting the process cartridge shown in FIG. 3.

At first the photosensitive drum unit 300 will be explained with reference to FIG. 7(*a*).

A unit frame 301 is provided with attach/detaching guides 301*a*1 provided on the external faces of lateral plates 301*a*, upper arms 301*b* extending diagonally upwards, and an exposure aperture 301*c* positioned between said arms 301*b*. Said lateral plates 301*a*, guides 301*a*1, arms 301*b* and exposure aperture are integrally molded. Under said frame 301 there is openably provided a photosensitive drum protecting cover 301*d*. Said guides 301*a*1 serve to guide the process cartridge 500 in attaching to or detaching from the printer (to be explained later). Said exposure aperture 301*b* constitutes an exposure aperture in cooperation with a frame of a developing unit 400, when the process cartridge 500 is composed by coupling the photosensitive drum unit 300 and the developing unit 400. The protective cover 301*d* is mounted on an arm 301*d*2 rotatable about a shaft 301*d*1. It is retracted from a protecting position (illustrated) for protecting the periphery of the photosensitive drum to a retracted position, when an engaging part 301*d*3 integral with the arm 301*d*2 engages with an engaging part of the main body, and returns to said protecting position when said engaging parts are disengaged upon detachment of the cartridge 500 from the main body. In this manner the protective cover 301*d* is opened and closed, in response to the attachment and detachment of the cartridge.

Between the lateral plates 301*a*, a photosensitive drum 302 is rotatably supported by bearings. Said drum 302 is provided with a helical gear 302*a* at an end, a flat-tooth gear 302*b* at the other end, and an electrophotographic photosensitive member 302*c* (for example an amorphous photosensitive member of an organic photoconductor (OPC)) on the periphery. Upon attachment of the cartridge in the main body, said helical gear 302*a* meshes with a helical gear (not shown) of the main body, thereby receiving the drum driving force. Also when the units are coupled, said gear meshes with a developing sleeve gear of the developing unit 400, thereby transmitting the sleeve driving force. A conductive bearing 302*d* engages with a conductive part (not shown) of the main body, thereby grounding the drum 104.

A charging roller 303 is pressed, with a predetermined pressure, to the periphery of the drum 302, by means of springs 303*a*. An electrical contact spring 303*b* elastically contacts the shaft 303*c* of the charging roller 303, thereby applying a predetermined voltage from the main body to said charging roller 303.

In the present embodiment, in each of the arms 301*b* there is provided an elongated recess 304, including therein apertures 304*b*, 304*c* on both sides of a female thread part 304*a*. The front aperture 304*b* serves to pass a compression spring provided in a stopper unit to be explained later, while the rear aperture 304*c* serves to accept a perpendicular plate also provided in the stopper unit.

Below said recess 304, there is provided a rectangular groove 307, for accepting a pin of the developing unit 400 to be explained later.

Legs 305 serve to support the process cartridge 500 when it is detached from the main body. A conductive metal plate 305 is mounted on the lateral plate 301*a*, in contact with the bearing 302*d*, by means of a screw 306*a*.

In the following, explained is the developing unit 400, with reference to FIG. 7(*b*).

A unit frame 401 is provided, at upper lateral positions, with externally extending cylindrical pins 402, between which formed is an exposure aperture 403. There are also provided a light shield plate 403*a* for limiting the light other than from the exposure aperture 403, a rear light shield plate 403*b* for further limiting the light entering from the exposure aperture, with notches 403*c* at the center and at both ends in order not to hinder the image exposure, and a vertical light shield plate 403*e*. Said rear light shield plate 403*b* protrudes toward the photosensitive drum 302, beyond the light shield plate 403*a*.

Concave portions, e.g., rectangular grooves 408 are provided for receiving compression springs, to be positioned in the vicinity of circular pillar-like portions. e.g., rectangular the pins 402, as will be explained later.

A developing roller 404, constituting the developing means, transports by rotation the toner from a toner reservoir 405 to a developed portion of the photosensitive drum 302. A magnet roller is incorporated in said developing sleeve 404. A helical gear 404*a* receives the driving force by meshing with the drum gear 302*a* of the photosensitive drum unit 300 when the units 300, 400 are coupled to constitute the cartridge 500.

A doctor blade 406, is provided for limiting the thickness of toner on the periphery of the sleeve 404. On both ends, there are provided felt members 406*a* for preventing lateral leak of the toner. Outside areas 406*b* are free from toner deposition.

Plastic rollers 407 are provided on both ends of the sleeve 404, and have a diameter slightly larger than that of the sleeve 404. Consequently in the present embodiment, when the units 300, 400 are coupled to constitute the process cartridge 500, the periphery of the photosensitive drum 302 comes into contact with those of the rollers 407, thereby defining a small gap (for example 200–500μ in the present embodiment) between the surfaces of the drum 302 and the sleeve 404. However such configuration is not essential, and said surfaces may be in direct contact. Screw 406*b* fix the blade 406 onto the frame 401.

In the following, there will be explained a stopper unit 600, serving as coupling means for coupling the units 300 and 400, with reference to FIGS. 6(*a*) and 6(*b*), which are respectively a plan view and a lateral view.

A screw hole 602, penetrating through a base member 601, accepts the male screw 700 (FIG. 3). A perpendicular plate 603 extends downwards from the lower face 601*a* of the base member 601, and serves to define the position of the pin.402 of the developing unit 400 by a lower lateral end 603*a*. A spring seat 604 is provided parallel to the perpendicular plate 603, and supports, at the end thereof, a compression spring 605 extending further downwards beyond the perpendicular plate 603. There are also provided hollow parts 606, 607.

The process cartridge 500 is assembled by coupling the units 300 and 400 in the following manner.

At first the photosensitive drum 302 of the unit 300 and the developing sleeve 404 of the unit 400 are positioned in mutually opposed manner, and the pins 402 on both sides of the unit 400 are inserted deeply into the rectangular grooves 307 on both sides of the unit 300, whereby the units 300 and 400 are mutually combined in such a manner that the arms 301*b* of the unit 300 cover the frame 401 of the unit 400.

Then, the stopper unit 600 is fitted into each of the recess 304. In this state, the front aperture 304*c* of the unit 300 faces the rectangular groove 408 of the unit 400, while the rear aperture 304*c* faces the rectangular groove 307. Thus the stopper unit 600 is fitted into the recess 304, by fitting the compression spring 605 through the front aperture 304*b* into the rectangular groove 408, and fitting the perpendicular plate 603 through the rear aperture 304*c*.

Subsequently, the male screw 700 is fixed to the female thread 304*a* through the screw hole 602 of the stopper unit 600, thereby fixing the stopper unit 600 to the unit 300. The assembly of the process cartridge 500 is thus completed (FIGS. 3 to 5).

Thus the pins 402 of the unit 400 are limited from movement by the lower lateral ends 603*a* of the perpendicular plates 603, whereby the units 300 and 400 are integrally coupled, with the pins 402 as the center of rotation. At the same time with the mounting of the stopper unit 600, the developing sleeve 404 is pressed by the elastic force of the compression springs 605, toward the periphery of the photosensitive drum 302. In the present embodiment, the peripheries of the drum 302 and the rollers 407 come into mutual contact, thereby defining the positions thereof. (In the present embodiment, a gap (for example about 200–500μ) is formed between the peripheries of the drum 302 and the sleeve 404 in order to enable so-called jumping development, but these members may be in direct contact.)

Thus, the present embodiment can achieve the coupling of the photosensitive drum unit 300 and the developing unit 400 and the positioning of the photosensitive drum 302 and the developing sleeve 404 in a same assembling step, thereby shortening the assembling process.

Also in the present embodiment, when the units 300 and 400 are mutually coupled, the exposure aperture 301*c* of the unit 300 becomes positioned above the exposure aperture 403 of the unit 400, thereby defining an exposure aperture of a predetermined size (for introducing the image light from the main body of the printer). Thus, in the coupled state of the units 300 and 400, the frames 301, 401 cooperate each other to form the exposure aperture. The present embodiment can therefore improve the strength of the frames, as a large hole for image exposure need not be formed in one of the frames. Also the present embodiment can minimize the intrusion of unnecessary light from the exposure aperture, because of the presence of the light shield plate 403*a*, rear light shield plate 403*b* and vertical light shield plate 403*c* in the process cartridge 500.

In FIG. 3, an arrow A indicates the image exposing light. Parallel recesses 409, formed on the external surface of the frame 401 of the unit 400 serve as grips in the transportation of the cartridge 500 (said recesses 409 being omitted from illustration in FIG. 7(*b*)). Arms 310 support the protective cover 301*d*, at a side opposite to the side supported by the arms 301*d*2. FIG. 5 illustrates a new process cartridge 500 prior to use. In FIG. 5, there is provided a rotary blade 411, rotated in a direction B to feed the toner 412 toward the sleeve 404. An elastic cleaning blade 311, serving as the cleaner, is in contact with the periphery of the photosensitive drum 302, thereby removing the toner remaining thereon after the image transfer. A used toner reservoir 312 stores the toner scraped by the blade 311. C indicates the protecting position of the protective cover 301*d*, while D indicates the retracted position thereof. In this drawing, for facilitating the understanding, the protective cover 301*d* is illustrated in solid lines both in the protecting position C and in the retracted position D.

Figure 8:
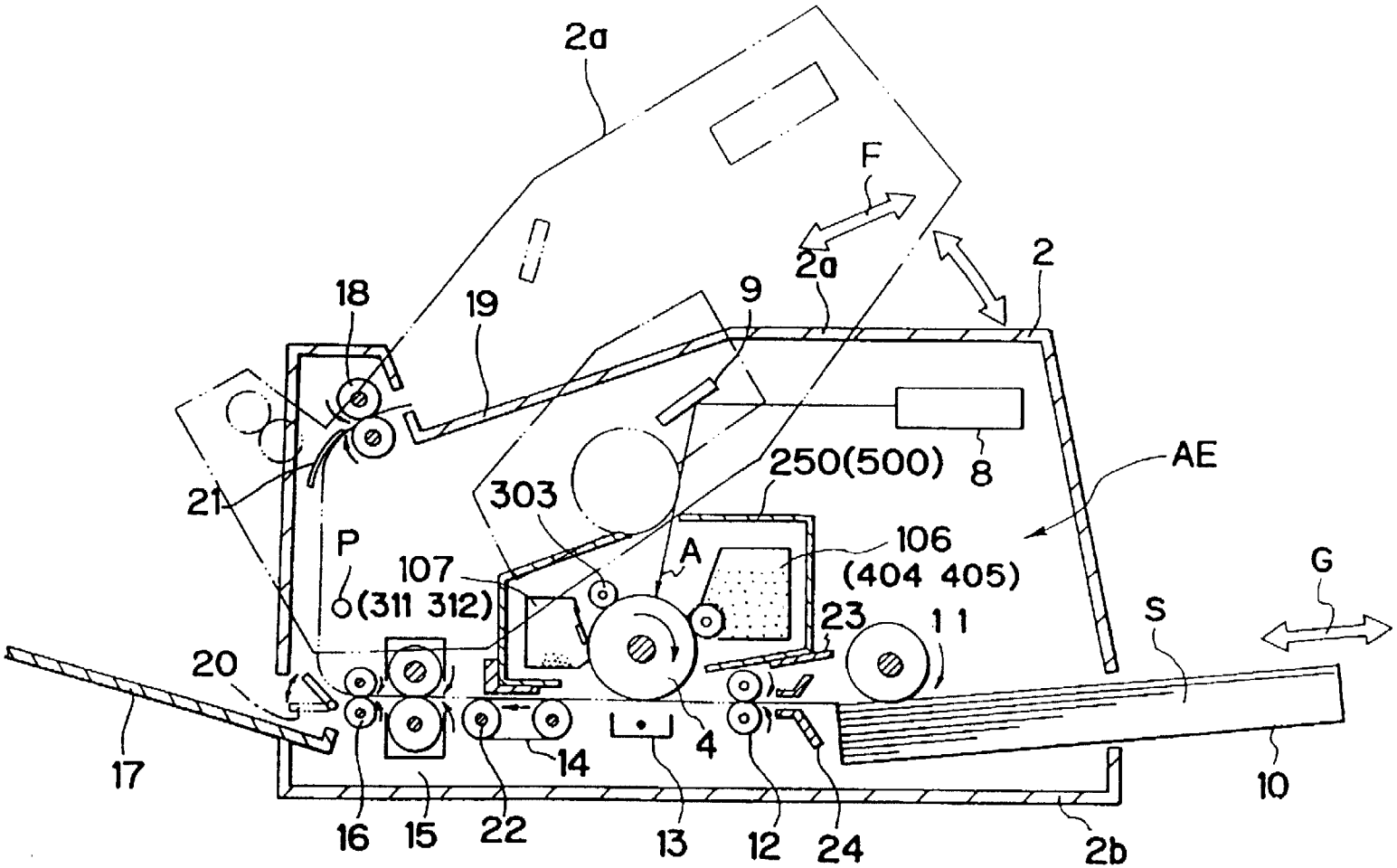
FIG. 8 is a lateral cross-sectional view of a laser beam printer in which the present invention is applicable.

Now reference is made to FIG. 8, for explaining a laser beam printer, in which the afore-mentioned process cartridge 250, 500 is detachably mounted. It is to be noted that, in FIG. 8, said process cartridge 250, 500 is only schematically illustrated.

As shown in FIG. 8, a laser beam printer 1 includes a process cartridge 250 (500) detachably mounted in a main body 2, and said process cartridge 250 (500) includes a photosensitive drum 104 (320) serving as the image bearing member, and process means such as a charger 303, a developing device 106 (404, 405 etc.), a cleaner 107 (311, 132) etc. positioned around said drum. In the upper part of the main body 2 there are provided a scanner unit 8 and a mirror 9 for emitting and guiding a laser beam.

The photosensitive drum 104 (302) uniformly charged by the charger 303 is irradiated by the laser beam, corresponding to the image information, from the unit 8 (indicated by arrow A), whereby a latent image corresponding to the image information is formed on the photosensitive drum 104 (302). Said latent image is developed into a toner image by the developing device 106 (404,405 etc.). In the lower part of the main body 2, there is provided a sheet cassette 10 containing a plurality of sheets S serving as the recording medium (for example recording paper or overhead projector sheet). Next to the sheet cassette 10, there is provided a feed roller 11, which feeds the sheets S, one by one, from the cassette 10 to registration rollers 12. With a timing adjusted by the registration rollers 12, the sheet S is advanced to an image transfer position between the photosensitive drum 104 (302) and a transfer charger 13, and the toner image on said photosensitive drum 104 (302) is transferred, in said transfer position, onto the sheet S. After the toner image transfer, the sheet S is transported by a conveyor belt unit 14 to a fixing unit 15 for fixation of said toner image, and is discharged from the main body 2.

The laser beam printer of the present embodiment can select two methods in the discharge of the sheet S.

In the first face-up discharge method in which the sheets S are discharged with the image bearing faces thereof upwards, the sheet is discharged from face-up discharge rollers 16 onto a face-up discharge tray 17. In the second face-down discharge method in which the sheets S are discharged with the image bearing faces thereof downwards and in the order of pages, the sheet S is guided from said face-up discharge rollers 16 upwards through a transport direction switching mechanism such as a flapper 20 and a sheet guide member 21, thereby being inverted, and is discharged from face-down discharge rollers 18 onto a face-down discharge tray 19.

The maintenance works of the laser beam printer 1, such as the disposal of jammed sheet or replacement of the process cartridge 250 (500), are conducted by exposing the interior of the apparatus by rotating the upper part 2*a* of the main body 2 upwards about a shaft P, as indicated by chain lines, relative to the lower part 2*b*, and inserting a hand in a direction E.

Also, the attaching and detaching of the process cartridge 250 (500) are conducted in a direction F. More specifically, the cartridge 250 (500) is introduced into the main body 1 along the direction F, then is guided toward the mounting position, with the guides 301*a*1 of the cartridge guided by guide members (not shown) of the main body, and is supported in the mounting position by mounting means 22, 23. Subsequently the upper part 2*a* is rotated clockwise about the shaft P, whereby the apparatus becomes capable of image formation. With said clockwise rotation of the upper part 2*a*, an engaging part 301*d*3 of the protective cover 301*d* engages with an engaging part (not shown) of the main body, whereby the arms 301*d*2 are rotated anticlockwise to move the protective cover 301*d* to the retracted positon D. On the other hand, when the upper part 2*a* is opened by anticlockwise rotation, said engaging parts are disengaged whereby the protective cover 301*d* moves to the protecting position C by the elastic force of the springs 301*d*4.

24 indicates guide members. The sheet cassette 10 can be attached and detached in a direction G. The foregoing embodiments are not limitative, and the photosensitive drum unit needs only to contain at least the photosensitive drum, while the developing unit needs only to contain at least the developing device.

As explained in the foregoing, the present invention realizes to shorten the assembling process.

I claim:

1. A connecting part for assembling a process cartridge having first and second frames and which is detachably mountable on a main body of a recording apparatus, said connecting part comprising:

a base member;

a protrusion provided on said base member; and a compression spring attachment portion disposed on said base member adjacent to said protrusion for attaching a compression spring thereto, wherein a hole is formed in said base member for allowing penetration of a screw used for fastening said base member to the first frame of the process cartridge, and wherein said protrusion locks a rotation shaft provided on the second frame to the first frame such that the first frame and the second frame are rockable relative to each other, the compression spring presses the second frame in a direction to urge a developing roller in the second frame toward a photosensitive member supported in the first frame, and said base member is fastened to the first frame.

2. A connecting part according to claim 1, wherein the photosensitive member is drum-shaped, and wherein said connecting part assembles the process cartridge by rockably locking the second frame, which supports developing means for developing a latent image formed on the photosensitive member, the developing means comprising the developing roller and a toner reservoir for containing toner to be supplied to the developing roller, to the first frame, which supports the photosensitive member.

3. A connecting part for assembling a process cartridge having first and second frames and which is detachably mountable on a main body of a recording apparatus, said connecting part comprising:

a base member;

a protrusion provided on said base member; and a compression spring attachment portion disposed on said base member adjacent to said protrusion for attaching a compression spring thereto, wherein a hole is formed in said base member for allowing penetration of a screw used for fastening said base member to the first frame of the process cartridge, and wherein said connecting part assembles the process cartridge by rockably locking the second frame, which supports developing means for developing a latent image formed on an image bearing member, to the first frame, which supports the image bearing member.

4. A connecting part according to claim 3, wherein the developing means comprises a developing roller, and the image bearing member comprises a photosensitive member, and wherein said protrusion locks a rotational shaft provided on the second frame to the first frame such that the first frame and the second frame are rockable relative to each other, the compression spring presses the second frame in a direction to urge the developing roller in the second frame toward the photosensitive member in the first frame, and said base member is fastened to the first frame.

5. A connecting part for assembling a process cartridge having first and second frames and which is detachably mountable on a main body of a recording apparatus, said connecting part comprising:

a base member a protrusion provided on said base member; and a compression spring attaching seat disposed on said base member and adjacent to said protrusion for attaching a compression spring thereto, wherein a hole is formed in said base member for allowing penetration of a screw used for fastening said base member to the first frame of the process cartridge.

6. A connecting part according to claim 5, wherein said protrusion locks a rotational shaft provided on the second frame to the first frame such that the first frame and the second frame are rockable relative to each other, the compression spring presses the second frame in a direction to urge a developing roller in the second frame toward an image bearing member comprising a photosensitive member supported in the first frame, and said base member is fastened to the first frame.

7. A connecting part according to claim 5, wherein said connecting part assembles the process cartridge by rockably locking the first frame, which supports an image bearing member, to the second frame, which supports developing means for developing a latent image formed on the image bearing member.

8. A connecting part for assembling a process cartridge having first and second frames and which is detachably mountable on a main body of a recording apparatus, said connecting part comprising:

a base member;

a protrusion provided on said base member; and a compression spring attachment portion disposed on said base member adjacent to said protrusion for attaching a compression spring thereto, wherein said protrusion locks a rotation shaft provided on the second frame to the first frame such that the first frame and the second frame are rockable relative to each other, the compression spring presses the second frame in a direction to urge a developing roller in the second frame toward a photosensitive member supported in the first frame, and said base member is fastened to the first frame.

9. A connecting part according to claim 8, wherein the photosensitive member is drum-shaped, and wherein said connecting part assembles the process cartridge by rockably locking the second frame, which supports developing means for developing a latent image formed on the photosensitive member, the developing means comprising the developing roller and a toner reservoir for containing toner to be supplied to the developing roller, to the first frame, which supports the photosensitive member.

10. A connecting part for assembling a process cartridge having first and second frames and which is detachably mountable on a main body of a recording apparatus, said connecting part comprising:

a base member;

a protrusion provided on said base member; and a compression spring attachment portion disposed on said base member adjacent to said protrusion for attaching a compression spring thereto, wherein said connecting part assembles the process cartridge by rockably locking the second frame, which supports developing means for developing a latent image formed on an image bearing member, to the first frame, which supports the image bearing member.

11. A connecting part according to claim 10, wherein the developing means comprises a developing roller, and the image bearing member comprises a photosensitive member, and wherein said protrusion locks a rotational shaft provided on the second frame to the first frame such that the first frame and the second frame are rockable relative to each other, the compression spring presses the second frame in a direction to urge the developing roller in the second frame toward the photosensitive member in the first frame, and said base member is fastened to the first frame.

12. A connecting part for assembling a process cartridge having first and second frames and which is detachably mountable on a main body of a recording apparatus, said connecting part comprising:

a base member;

a protrusion provided on said base member; and a compression spring attaching seat disposed on said base member and adjacent to said protrusion for attaching a compression spring thereto.

13. A connecting part according to claim 12, wherein said protrusion locks a rotational shaft provided on the second frame to the first frame such that the first frame and the second frame are rockable relative to each other, the compression spring presses the second frame in a direction to urge a developing roller in the second frame toward an image bearing member comprising a photosensitive member supported in the first frame, and said base member is fastened to the first frame.

14. A connecting part according to claim 12, wherein said connecting part assembles the process cartridge by rockably locking the first frame, which supports an image bearing member, to the second frame, which supports developing means for developing a latent image formed on the image bearing member.

15. A connecting part used for assembling a process cartridge detachably mountable onto a main body of a recording apparatus and comprising a first frame and a second frame, said connecting part comprising:

a base member;

a protrusion provided on said base member;

a compression spring attachment portion provided on said base member adjacent to said protrusion for attaching a compression spring thereto; and a screw hole allowing penetration of a screw member for fastening said base member to the first frame, wherein the first frame supports an electrophotographic photosensitive drum and has at both ends thereof above the photosensitive drum a first opening into which said protrusion can be inserted, a second opening into which the compression spring can be inserted, a screwing portion for screwing said base member by a screw member, between the first opening and the second opening, and an engaging portion having one side open to permit passage of a shaft of the second frame, while the second frame supports developing means for developing a latent image formed on the photosensitive drum and has at both ends thereof above the developing means concave portions for receiving the compression spring.

16. A connecting part used for assembling a process cartridge detachably mountable onto a main body of a recording apparatus and comprising a first frame and a second frame, said connecting part comprising:

a base member;

a protrusion provided on said base member; and a compression spring attachment portion provided on said base member adjacent to said protrusion for attaching a compression spring thereto, wherein the first frame supports an electrophotographic photosensitive drum and has at both ends thereof above the photosensitive drum a first opening into which said protrusion can be inserted, a second opening into which the compression spring can be inserted, and an engaging portion having one side open to permit passage of a shaft of the second frame, while the second frame supports developing means for developing a latent image formed on the photosensitive drum and has at both ends thereof above the developing means concave portions for receiving the compression spring.

17. A connecting part to be used for connecting a cleaning frame and a developing frame to assemble a process cartridge removably mountable onto a main body of an electrophotographic image forming apparatus, wherein (a) said cleaning frame includes an electrophotographic photosensitive drum, a charging roller for charging said electrophotographic photosensitive drum, a cleaning member for removing toner from said electrophotographic photosensitive drum, a first opening provided at a position corresponding to one of two ends of said electrophotographic photosensitive drum in a longitudinal direction thereof and above said electrophotographic photosensitive drum to allow penetration of a protrusion of said connecting part, a latching portion for latching a base member of said connecting part, an engaging portion having one side that is opened to be penetrated through and engaged with a shaft of said developing frame, wherein, when said cleaning frame and said developing frame are connected, said protrusion prevents said shaft, which is engaged with said engaging portion, from disengaging with said engaging portion when said protrusion is penetrated through said first opening; and (b) said developing frame includes a developing sleeve for developing a latent image formed on said electrophotographic photosensitive drum, and a shaft provided at a position corresponding to one end of said electrophotographic photosensitive drum in a longitudinal direction thereof and above said electrophotographic photosensitive drum, said shaft engaging with said engaging portion of said cleaning frame when said developing frame and said cleaning frame are connected; said connecting part comprising:

a base member;

a protrusion provided on said base member for preventing said shaft of said developing frame from disengaging from said engaging portion of said cleaning frame when said protrusion is inserted into said first opening; and a connecting part latching portion provided on said base member for latching said connecting part to said cleaning frame, wherein said connecting part is latched to said cleaning frame in a state where said protrusion is penetrated through said first opening to prevent said shaft engaged with said engaging portion from disengaging therefrom.

18. A connecting part according to claim 17, wherein said latching portion is a latching portion hole provided between said first opening and a second opening in said cleaning frame, and wherein said connecting part latching portion is a through-hole through which a screw member is penetrable for fastening said base member to said cleaning frame, said screw member penetrating through said through-hole to be screwed with said latching portion hole to thereby latch said connecting part to said cleaning frame, said connecting part being removable from said cleaning frame by unscrewing the screw member.

19. A connecting part according to claim 18, further comprising spacers provided at both ends of said developing sleeve in a longitudinal direction thereof, and further comprising a compression spring attaching portion for attaching a compression spring to said base member adjacent to said protrusion, said connecting part latching portion being disposed between said protrusion and said compression spring attaching portion, wherein, when said cleaning frame and said developing frame are connected, said spacers contact a circumferential surface of said electrophotographic photosensitive drum due to a resilient force of said compression spring to thereby maintain a gap between said electrophotographic photosensitive drum and said developing sleeve.

20. A connecting part according to claim 18, further comprising spacers provided at both ends of said developing sleeve in a longitudinal direction thereof, and further comprising a compression spring attached to said base member adjacent to said protrusion, wherein spring receiving portions are provided on said developing frame above said developing sleeve and at the positions corresponding to both ends of said developing sleeve in a longitudinal direction thereof, wherein, when said base member of said connecting part is latched to said cleaning frame, said connecting part presses said compression spring, which is penetrated through said second opening provided on said cleaning frame to be aligned with said spring receiving portion, against said spring receiving portion, and wherein, when said cleaning frame and said developing frame are connected, said spacers contact a circumferential surface of said electrophotographic photosensitive drum due to a resilient force of said compression spring to thereby maintain a gap between said electrophotographic photosensitive drum and said developing sleeve.

21. A connecting part according to claim 17, further comprising spacers provided at both ends of said developing sleeve in a longitudinal direction thereof, and further comprising a compression spring attaching portion for attaching a compression spring to said base member adjacent to said protrusion, said connecting part latching portion being disposed between said protrusion and said compression spring attaching portion, wherein, when said cleaning frame and said developing frame are connected, said spacers contact a circumferential surface of said electrophotographic photosensitive drum due to a resilient force of said compression spring to thereby maintain a gap between said electrophotographic photosensitive drum and said developing sleeve.

22. A connecting part according to claim 17, further comprising spacers provided at both ends of said developing sleeve in a longitudinal direction thereof, and further comprising a compression spring attached to said base member adjacent to said protrusion, wherein spring receiving portions are provided on said developing frame above said developing sleeve and at the positions corresponding to both ends of said developing sleeve in a longitudinal direction thereof, wherein, when said base member of said connecting part is latched to said cleaning frame, said connecting part presses said compression spring, which is penetrated through a second opening provided on said cleaning frame to be aligned with said spring receiving portion, against said spring receiving portion, and wherein, when said cleaning frame and said developing frame are connected, said spacers contact a circumferential surface of said electrophotographic photosensitive drum due to a resilient force of said compression spring to thereby maintain a gap between said electrophotographic photosensitive drum and said developing sleeve.

23. A connecting part to be used for connecting a cleaning frame and a developing frame to thereby assemble a process cartridge that is removably mountable onto a main body of an electrophotographic image forming apparatus, wherein (a) the cleaning frame includes an electrophotographic photosensitive drum; a charging roller abutted against said electrophotographic photosensitive drum for charging said electrophotographic photosensitive drum; a cleaning blade abutted against said electrophotographic photosensitive drum for removing toner therefrom; a first opening provided above said electrophotographic photosensitive drum and at a position corresponding to one of two ends of said electrophotographic photosensitive drum in a longitudinal direction thereof for allowing penetration of a protrusion of said connecting part; a second opening for allowing penetration of a compression spring of said connecting part; a hole, disposed between said first opening and said second opening, with which a screw member for fastening a base member of said connecting member engages; and an engaging portion having one side that is opened to allow penetration of a shaft of said developing frame for engaging said shaft and being disposed below said first opening, said second opening, and said hole; and (b) the developing frame includes a developing sleeve, having spacers at both ends in a longitudinal direction thereof, for developing a latent image formed on said electrophotographic photosensitive drum; a spring receiving portion, provided above said developing sleeve attached to a developing sleeve attaching portion and at a position corresponding to each end of said developing sleeve in a longitudinal direction thereof, the compression spring attached to said connecting part being abutted against said spring receiving portion; a shaft provided above said developing sleeve and at the position corresponding to each end of said developing sleeve in the longitudinal direction thereof, said shaft engaging with said engaging portion of said cleaning frame when said developing frame and said cleaning frame are connected; and a toner containing portion provided on a toner frame for containing toner to be used for the developing operation by said developing sleeve, said toner frame being connected with said developing frame and having a grip portion on an outer surface thereof to be gripped when said process cartridge is mounted onto and dismounted from the main body of the electrophotographic image forming apparatus; said connecting part comprising:

a base member;

a protrusion provided on said base member, said protrusion being penetrated through said first opening to prevent said shaft of said developing frame from disengaging from said engaging portion of said cleaning frame when said developing frame and said cleaning frame are connected;

a compression spring attaching portion for attaching the compression spring to said base member adjacent to said protrusion, the compression spring attached to said compression spring attaching portion being penetrated through said second opening to press said spring receiving portion of said developing frame for bringing said spacers into contact with a circumferential surface of said electrophotographic photosensitive drum, thereby maintaining a gap between said electrophotographic photosensitive drum and said developing sleeve; and a through-hole provided on said base member for allowing penetration of said screw member for fastening said base member to said cleaning frame, said through-hole being disposed between said protrusion and said compression spring attaching portion, wherein, in a state where the compression spring attached to said connecting member is penetrated through said second opening and aligned with said spring receiving portion to be pressed against said spring receiving portion, and in a state where said protrusion of said connecting part is penetrated through said first opening for preventing said shaft of said developing frame engaged with said engaging portion from being disengaged therefrom, said base member of said connecting part is fastened to said cleaning frame by said screw member, and said connecting member can be removed from said cleaning frame by unscrewing said screw member.

24. A connecting part for assembling a process cartridge having a first frame and a second frame and which is detachably mountable on a main body of a recording apparatus, said connecting part comprising:

a base member;

a protrusion provided on said base member; and a compression spring attachment portion disposed on said base member adjacent to said protrusion and onto which a compression spring is attachable, wherein a hole is formed in said base member for allowing penetration of a screw used for fastening said base member to the first frame of the process cartridge, and wherein said protrusion prevents a shaft provided on the second frame of the process cartridge from disengaging from an engagement portion provided on the first frame such that the first frame and the second frame are rockable relative to each other, wherein the compression spring presses the second frame in a direction to urge a developing roller supported in the second frame toward an electrophotographic photosensitive drum supported in the first frame, and wherein said base member is fastened to the first frame.

25. A connecting part for assembling a process cartridge having a first frame and a second frame and which is detachably mountable on a main body of a recording apparatus, said connecting part comprising:

a base member;

a protrusion provided on said base member; and a compression spring attachment portion disposed on said base member adjacent to said protrusion and onto which a compression spring is attachable, the compression spring applying a resilient force between the first frame and the second frame when the first frame and the second frame are connected by said connecting part, wherein a hole is formed in said base member for allowing penetration of a screw used for fastening said base member to the first frame of the process cartridge, and wherein said connecting part assembles the process cartridge by rockably locking the second frame, which supports a developing roller for developing a latent image formed on an electrophotographic photosensitive drum, to the first frame, which supports the electrophotographic photosensitive drum.

26. A connecting part for assembling a process cartridge having a first frame and a second frame, an electrophotographic photosensitive drum, and a developing roller for developing a latent image formed on the photosensitive drum, and which is detachably mountable on a main body of a recording apparatus, said connecting part comprising:

a base member;

a protrusion provided on said base member; and a compression spring attaching seat, disposed on said base member and adjacent to said protrusion, onto which a compression spring is attachable, the compression spring applying a resilient force between the first frame and the second frame when the first frame and the second frame are connected by said connecting part, wherein a hole is formed in said base member for allowing penetration of a screw used for fastening said base member to the first frame of the process cartridge, to thereby prevent disengagement, between a first engagement portion provided on the first frame and a second engagement portion provided on the second frame, by said protrusion upon connecting the first frame and the second frame.

27. A connecting part for assembling a process cartridge having a first frame and a second frame and which is detachably mountable on a main body of a recording apparatus, said connecting part comprising:

a base member;

a protrusion provided on said base member; and a compression spring attachment portion, disposed on said base member adjacent to said protrusion and onto which a compression spring is attachable, wherein a hole is formed in said base member for allowing penetration of a screw used for fastening said base member to the first frame of the process cartridge, and wherein said protrusion prevents a shaft provided on the second frame of the process cartridge from disengaging from an engagement portion provided on the first frame such that the first frame and the second frame are rockable relative to each other, wherein the compression spring presses the second frame in a direction to urge a developing roller supported in the second frame toward an electrophotographic photosensitive drum supported in the first frame, and wherein said base member is fastened to the first frame.

28. A connecting part for assembling a process cartridge having a first frame and a second frame and which is detachably mountable on a main body of a recording apparatus, said connecting part comprising:

a base member;

a protrusion provided on said base member; and a compression spring attachment portion disposed on said base member adjacent to said protrusion and onto which a compression spring is attachable, the compression spring applying a resilient force between the first frame and the second frame when the first frame and the second frame are connected by said connecting part, wherein said connecting part assembles the process cartridge by rockably locking the second frame, which supports a developing roller for developing a latent image formed on an electrophotographic photosensitive drum, to the first frame, which supports the electrophotographic photosensitive drum.

29. A connecting part for assembling a process cartridge having a first frame and a second frame and which is detachably mountable on a main body of a recording apparatus, said connecting part comprising:

a base member;

a protrusion provided on said base member; and a compression spring attaching seat disposed on said base member and adjacent to said protrusion, onto which a compression spring is attachable, the compression spring applying a resilient force between the first frame and the second frame when the first frame and the second frame are connected by said connecting part, wherein a hole is formed in said base member for allowing penetration of a screw used for fastening said base member to the first frame of the process cartridge, to thereby prevent disengagement, between a first engagement portion provided on the first frame and a second engagement portion provided on the second frame, by said protrusion upon connecting the first frame and the second frame.

30. A connecting part used for assembling a process cartridge having a first frame and a second frame and which is detachably mountable onto a main body of a recording apparatus, wherein the first frame supports an electrophotographic photosensitive drum and has at both substantially longitudinal ends above the photosensitive drum a first opening into which a first protrusion of said connecting part can be inserted, a second opening into which a compression spring of said connecting part can be inserted, a screwing portion between the first opening and the second opening for screwing a base member of said connecting part by a screw member, and an engaging portion having one side open to permit passage of a shaft of the second frame, and wherein the second frame supports a developing device including a developing sleeve for developing a latent image formed on the photosensitive drum and has at both substantially longitudinal ends above the developing device a concave portion for receiving said compression spring of said connecting part, said connecting part comprising:

a base member comprising a first rectangular recess extending in a width-wise direction on a top surface of said base member, a second rectangular recess extending in a longitudinal direction on said top surface of said base member, and a circular through-hole extending through said base member and positioned between said first rectangular recess and said second rectangular recess;

a first substantially hollow protrusion that protrudes a first distance from a lower surface of said base member, said first substantially hollow protrusion comprising a base protrusion portion having a first length and a first width, an end protrusion portion having said first width and a second length shorter than said first length, and a transition portion of variable length that connects said base protrusion portion and said end protrusion portion;

a second substantially hollow protrusion that protrudes a second distance from said lower surface of said base member that is less than said first distance, said second substantially hollow protrusion having said first width and a third length between said first length and said second length of said first substantially hollow protrusion;

an attaching seat disposed on said second substantially hollow protrusion and comprising a base seat portion having an axial projection portion disposed thereon; and a compression spring provided on said attaching seat, wherein said circular through-hole allows penetration of the screw member for fastening said base member to the first frame to thereby rockably connect the first frame and the second frame in accordance with a compression force of said compression spring.

31. A connecting part used for assembling a process cartridge having a first frame and a second frame and which is detachably mountable onto a main body of a recording apparatus, wherein the first frame supports an electrophotographic photosensitive drum and has at both substantially longitudinal ends above the photosensitive drum a first opening into which a protrusion of said connecting part can be inserted, a second opening into which a compression spring of said connecting part can be inserted, a screwing portion between the first opening and the second opening for screwing a base member of said connecting part by a screw member, and an engaging portion having one side open to permit passage of a shaft of the second frame, and wherein the second frame supports a developing device including a developing sleeve for developing a latent image formed on the photosensitive drum and has at both substantially longitudinal ends above the developing device a concave portion for receiving said compression spring of said connecting part, said connecting part comprising:

a base member comprising an attaching seat;

a protrusion provided on said base member; and a compression spring provided on said attaching seat and adjacent to said protrusion, wherein a screw hole is formed in said base member between said protrusion and said attaching seat for allowing penetration of the screw member for fastening said base member to the first frame to thereby rockably connect the first frame and the second frame.

32. A connecting part for assembling a process cartridge having a first frame and a second frame and which is detachably mountable on a main body of a recording apparatus, said connecting part comprising:

a base member;

a protrusion provided on said base member;

a compression spring attachment portion disposed on said base member adjacent to said protrusion and onto which a compression spring is attachable; and a fastening portion provided on said base member and disposed between said protrusion and said compression spring attachment portion, wherein said fastening portion is used to fasten said base member to the first frame of the process cartridge, and wherein said protrusion prevents a shaft provided on the second frame of the process cartridge from disengaging from an engagement portion provided on the first frame such that the first frame and the second frame are rockable relative to each other, wherein the compression spring presses the second frame in a direction to urge a developing roller supported in the second frame toward an electrophotographic photosensitive drum supported in the first frame, and wherein said base member is fastened to the first frame.

33. A connecting part for assembling a process cartridge having a first frame and a second frame and which is detachably mountable on a main body of a recording apparatus, said connecting part comprising:

a base member;

a protrusion provided on said base member;

a compression spring attachment portion disposed on said base member adjacent to said protrusion and onto which a compression spring is attachable, the compression spring applying a resilient force between the first frame and the second frame when the first frame and the second frame are connected by said connecting part; and a fastening portion provided on said base member and disposed between said protrusion and said compression spring attachment portion, wherein said fastening portion is used to fasten said base member to the first frame of the process cartridge, and wherein said connecting part assembles the process cartridge by rockably locking the second frame, which supports a developing roller for developing a latent image formed on an electrophotographic photosensitive drum, to the first frame, which supports the electrophotographic photosensitive drum.

34. A connecting part for assembling a process cartridge having a first frame and a second frame, an electrophotographic photosensitive drum, and a developing roller for developing a latent image formed on the photosensitive drum, and which is detachably mountable on a main body of a recording apparatus, said connecting part comprising:

a base member;

a protrusion provided on said base member;

a compression spring attaching seat, disposed on said base member and adjacent to said protrusion, onto which a compression spring is attachable, the compression spring applying a resilient force between the first frame and the second frame when the first frame and the second frame are connected by said connecting part; and a fastening portion provided on said base member and disposed between said protrusion and said compression spring attachment portion, wherein said fastening portion is used to fasten said base member to the first frame of the process cartridge, to thereby prevent disengagement, between a first engagement portion provided on the first frame and a second engagement portion provided on the second frame, by said protrusion upon connecting the first frame and the second frame.

35. A connecting part for assembling a process cartridge having a first frame and a second frame and which is detachably mountable on a main body of a recording apparatus, said connecting part comprising:

a base member;

a protrusion provided on said base member;

a compression spring attachment portion, disposed on said base member adjacent to said protrusion and onto which a compression spring is attachable; and a fastening portion provided on said base member and disposed between said protrusion and said compression spring attachment portion, wherein said fastening portion is used to fasten said base member to the first frame of the process cartridge, and wherein said protrusion prevents a shaft provided on the second frame of the process cartridge from disengaging from an engagement portion provided on the first frame such that the first frame and the second frame are rockable relative to each other, wherein the compression spring presses the second frame in a direction to urge a developing roller supported in the second frame toward an electrophotographic photosensitive drum supported in the first frame, and wherein said base member is fastened to the first frame.

36. A connecting part for assembling a process cartridge having a first frame and a second frame and which is detachably mountable on a main body of a recording apparatus, said connecting part comprising:

a base member;

a protrusion provided on said base member;

a compression spring attaching seat disposed on said base member and adjacent to said protrusion, onto which a compression spring is attachable, the compression spring applying a resilient force between the first frame and the second frame when the first frame and the second frame are connected by said connecting part; and a fastening portion provided on said base member and disposed between said protrusion and said compression spring attachment portion, wherein said fastening portion is used to fasten said base member to the first frame of the process cartridge, to thereby prevent disengagement, between a first engagement portion provided on the first frame and a second engagement portion provided on the second frame, by said protrusion upon connecting the first frame and the second frame.

37. A connecting part used for assembling a process cartridge having a first frame and a second frame and which is detachably mountable onto a main body of a recording apparatus, wherein the first frame supports an electrophotographic photosensitive drum and has at both substantially longitudinal ends above the photosensitive drum a first opening into which a protrusion of said connecting part can be inserted, a second opening into which a compression spring of said connecting part can be inserted, a fastened portion between the first opening and the second opening for fastening a base member of said connecting part, and an engaging portion having one side open to permit passage of a shaft of the second frame, and wherein the second frame supports a developing device including a developing sleeve for developing a latent image formed on the photosensitive drum and has at both substantially longitudinal ends above the developing device a concave portion for receiving said compression spring of said connecting part, said connecting part comprising:

a base member comprising an attaching seat;

a protrusion provided on said base member;

a compression spring provided on said attaching seat and adjacent to said protrusion; and a fastening portion provided on said base member and disposed between said protrusion and said compression spring attachment portion, wherein said fastening portion is used to fasten said base member to the fastened portion of the first frame to thereby rockably connect the first frame and the second frame.

* * * * *

UNITED STATES PATENT AND TRADEMARK OFFICE

CERTIFICATE OF CORRECTION

PATENT NO. : 5,745,824

DATED : April 28, 1998

INVENTOR(S) : MASAHIKO YASHIRO

It is certified that error appears in the above-identified patent and that said Letters Patent is hereby corrected as shown below:

COLUMN 2

Line 6, "such" should read --such a--.

COLUMN 3

Line 1, "frees," should read --frames,--.

COLUMN 6

Line 8, "Cartridge" should read --cartridge--.
Line 33, "aperture" should read --aperture 301c--.

COLUMN 7

Line 33, "408" should read --408,--.
Line 35, "rectangular" should be deleted.
Line 45, "406," should read --406--.
Line 59, "fix" should read --fixes--.

COLUMN 8

Line 3, "pin.402" should read --pin 402--.
Line 57, "cooperate" should read --cooperate with--.

UNITED STATES PATENT AND TRADEMARK OFFICE

CERTIFICATE OF CORRECTION

PATENT NO. : 5,745,824

DATED : April 28, 1998

INVENTOR(S) : MASAHIKO YASHIRO

It is certified that error appears in the above-identified patent and that said Letters Patent is hereby corrected as shown below:

COLUMN 9

Line 19, "afore-mentioned" should read --aforementioned--.

COLUMN 11

Line 28, "member" should read --member;--.

Signed and Sealed this

Twenty-fourth Day of November, 1998

*Attest:*

Bruce Lehman

BRUCE LEHMAN

*Attesting Officer*

*Commissioner of Patents and Trademarks*